US006271448B1

(12) United States Patent
Steinberger

(10) Patent No.: US 6,271,448 B1
(45) Date of Patent: Aug. 7, 2001

(54) SLIDING CAPO

(76) Inventor: Richard Ned Steinberger, 420 Hill Top Rd., Nobleboro, ME (US) 04555

( * ) Notice: Subject to any disclaimer, the term of this patent is extended or adjusted under 35 U.S.C. 154(b) by 0 days.

(21) Appl. No.: 09/619,557

(22) Filed: Jul. 19, 2000

(51) Int. Cl.[7] ..... G10D 3/00
(52) U.S. Cl. ..... 84/318; 984/113; 984/114
(58) Field of Search ..... 984/113, 114; 84/318

(56) References Cited

U.S. PATENT DOCUMENTS

| | | | | |
|---|---|---|---|---|
| 339,513 | * | 4/1886 | Allen | 84/318 |
| 4,165,670 | * | 8/1979 | Cahn | 84/318 |
| 4,503,747 | * | 3/1985 | Labbe | 84/318 |
| 4,621,558 | | 11/1986 | Cornette | 84/318 |
| 5,033,349 | | 7/1991 | Nechville | 84/272 |
| 5,275,079 | * | 1/1994 | Castillo | 84/318 |
| 6,008,441 | | 12/1999 | Steinberger | 84/318 |

* cited by examiner

*Primary Examiner*—Robert E. Nappi
*Assistant Examiner*—Kim Lockett
(74) *Attorney, Agent, or Firm*—Saul Epstein

(57) ABSTRACT

A sliding Capo for a musical instrument of the lute family which rides in a track in the neck of the instrument. The Capo includes a rigid cross piece holding elongated flanges which ride in the track. A cylindrical elastomeric roller runs in bearings carried by the cross piece, and adjustment means are provided for adjusting the height of the roller above the fingerboard. In the case of curved fingerboards, the shaft on which the roller runs is flexible and springy, so that it can bend and the cylindrical roller can press all strings to the fingerboard.

15 Claims, 2 Drawing Sheets

SLIDING CAPO

BACKGROUND OF THE INVENTION

The present invention relates generally to musical instruments of the lute family (both electric and acoustic). In particular, the invention is a Capo which may be moved from place to place on the neck of a lute family instrument by merely sliding the Capo along the neck.

A Capo is a device for clamping the strings of a guitar or other stringed lute family instrument against the neck of the instrument in order to change the pitch of notes played. In the past, most Capos have involved screws, cams, and spring loaded clamps for attaching the device to the instrument neck. Spring loaded clamps have become popular because they can be opened and moved to a new position with one hand. However, one problem with prior art spring loaded Capos is that they require the musician to release and manipulate the Capo in order to change its location, and are hence relatively inconvenient to use, particularly during a performance.

Sliding type Capos also have been known in the prior art, e.g., U.S. Pat. Nos. 4,621,558 and 5,033,349, however these Capos have alignment as well as other problems. In the '558 and '349 Capos, for example, the Capo can easily turn with respect to the instrument neck and/or jam. During a performance, artists should not be distracted by the necessity of using care when moving a Capo. Additionally, prior art Capos intended to be used with curved fingerboards, e.g., the '558 patent, have a roller which is of non-uniform diameter, giving an unsightly appearance.

SUMMARY OF THE INVENTION

The invented Capo slides along the neck of the instrument, guided by a track, preferably comprised of a channel or shoulder on either side of the neck. A substantially rigid cross beam spans the fingerboard laterally, carrying a pair of elongated flanges which ride in the track. By elongated is meant relatively long in the lengthwise direction of the neck. I have found that a flange length of about one half of the width of the root of the track is adequate to prevent jamming of the Capo, and to keep the Capo aligned substantially parallel to the frets.

A shaft carrying a cylindrical rubber roller also spans the fingerboard, running in a pair of bearings in the cross beam. The position of the bearings normal to the fingerboard is adjustable, enabling the roller pressure against the strings to be set. When used in connection with a curved fingerboard, the shaft is flexible so that it can bend, permitting a cylindrical roller to be used. Hourglass shaped rollers used in the prior art are more difficult to fabricate than are cylindrical rollers, and are less cosmetically pleasing.

DETAILED DESCRIPTION OF THE INVENTION

Figure 1:
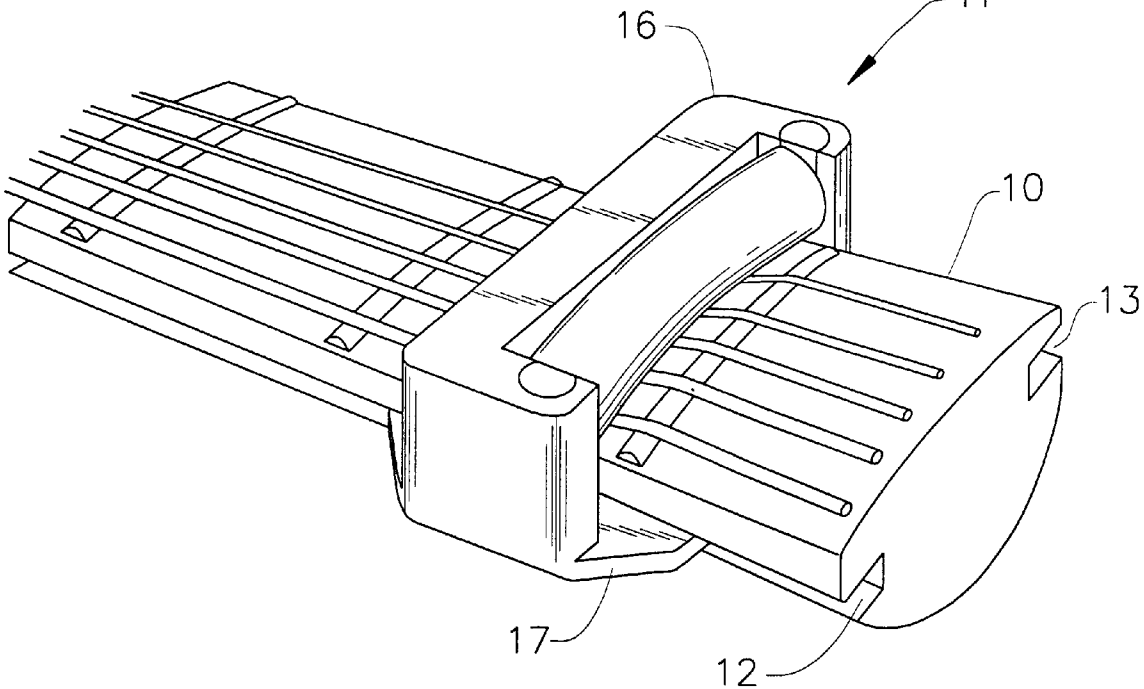
FIG. 1 is a perspective view of a portion of the neck of a stringed musical instrument suitable for use with the invented Capo, with a Capo installed.
Figure 5A:
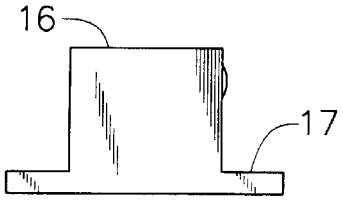
FIG. 5A is a left side view of the Capo of FIG. 4, turned 90° counterclockwise.
Figure 5B:
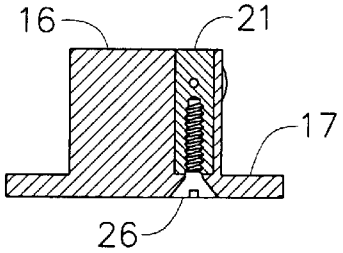
FIG. 5B is a cross sectional view of the Capo of FIG. 4 taken at 5B—5B of FIG. 4, turned 90° counterclockwise.
Figure 5C:
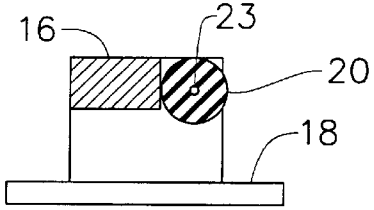
FIG. 5C is a cross sectional view of the Capo of FIG. 4 taken at 5C—5C of FIG. 4, turned 90° counterclockwise.

FIG. 1 depicts the neck 10 of a stringed instrument with the invented Capo 11 installed. The neck, as shown in FIG. 1, includes a track just under the fingerboard, the track being preferably a pair of channels 12 and 13 which extend lengthwise of the neck. Since the fingerboard of a necked musical instrument is often simply the top surface of the neck, instead of being a separate part, the term "neck" as used herein, where the context allows, includes a fingerboard, and the term "fingerboard" refers to either a separate piece, or merely the top surface of the neck. The channels 12 and 13 retain and guide the invented Capo, permitting it to be slid along the neck. Instead of channels such as shown in FIG. 1, a pair of shoulders, (e.g., shoulders 14 and 15 depicted in FIG. 2) could serve as a track, and accomplish the same purpose as channels 12 and 13. The track may be lined with metal or plastic, if desired, in order to reduce wear, and/or low friction materials may be used to reduce friction.

The invented Capo includes a substantially rigid cross member 16 and a pair of elongated flanges 17 and 18 which are intended to ride in channels 12 and 13. The length of the flanges and the gaps between them and the roots of channels 12 and 13 are such that the Capo will not bind as it is slid along the neck. The flanges could be separate pieces fastened to the cross member, or the flanges and cross member can be one piece, as is convenient. The one piece construction is illustrated.

Materials such as aluminum and delrin have been found to be satisfactory for the cross member and/or the flanges. Delrin is the presently preferred material, particularly for the flanges, because of its low friction properties. Delrin is an acetal resin produced by E. I. duPont de Nemours & Co. Other materials having appropriate characteristics may, of course, be used. Plastics, in general, are less stiff than metals, but delrin has been found to be adequately stiff when used for the rigid cross member.

Cross member 16 is cut away (indicated by the numeral 19) to receive roller 20, which is fabricated of rubber or other elastomer. A pair of bearing blocks 21 and 22, which carry shaft 23 in bearings 24 and 25, are inset in the ears of cross member 16 (which are formed by the cutout 19). Bearings 24 and 25 may simply be holes in the bearing blocks 21 and 22. When intended for use with curved fingerboards, the shaft is made of springy material (such as, e.g., hardened music wire), and relatively thin so that it can bend and allow the roller to conform to the shape of the fingerboard. The bearings 24 and 25 are, in such case, preferably tapered holes.

Figure 2:
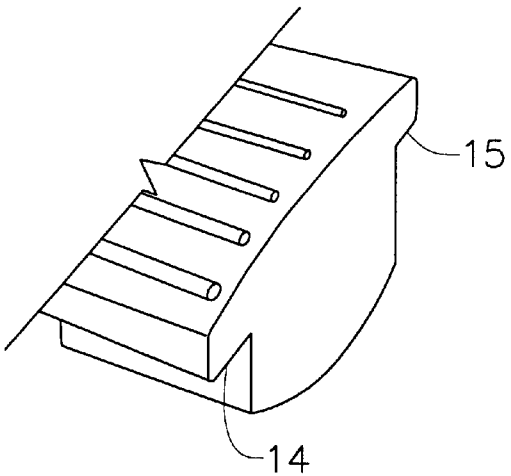
FIG. 2 is a perspective view of a small portion of a neck of a musical instrument for use with the invented Capo, illustrating an alternate neck construction.
Figure 3:
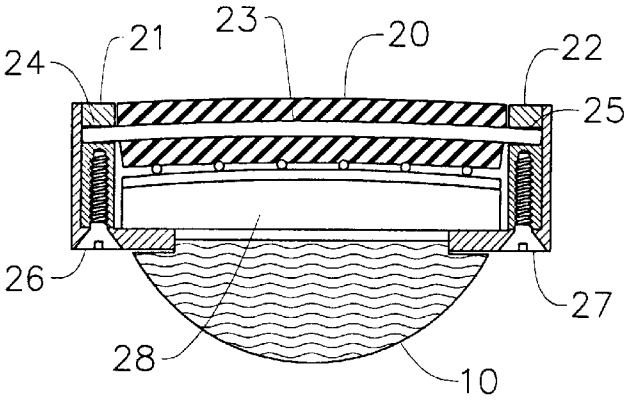
FIG. 3 is a cross sectional view of a presently preferred embodiment of the invented Capo taken at 3—3 of FIG. 4, showing the Capo installed on an instrument neck.
Figure 4:
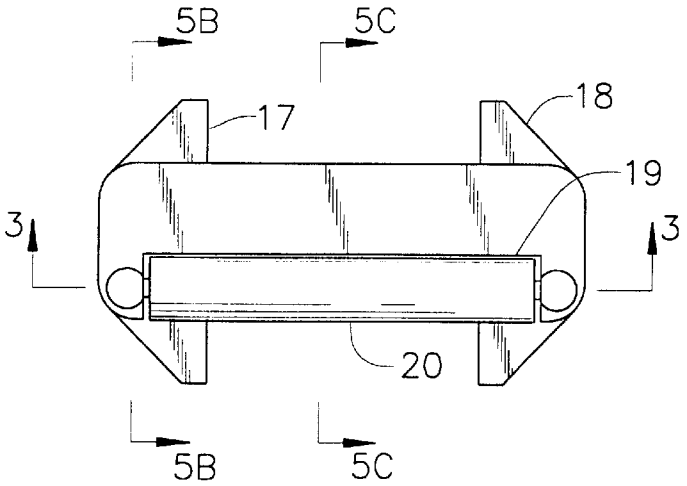
FIG. 4 is a top view of the invented Capo.

Screws 26 and 27 enable adjustment of the height of the bearings to set the roller pressure against the strings. If the Capo is used on an instrument with a curved neck (as illustrated in FIGS. 1, 2, and 3), tightening the screws 26 and 27 pulls the bearings 24 and 25 towards the neck of the instrument, and shaft 23 bends so that roller 20 will press all strings against the fingerboard 28.

In use, the invented Capo is merely slid to a position adjacent a desired fret; no looking or paying close attention to the attitude of the Capo is necessary. The elongated flanges, cooperating with the track, assures that the roller will always be parallel to the fret, as is important to produce the intended notes. If desired, the Capo and neck can be fitted with detents to aid the musician in properly positioning the Capo vis a vis the frets.

I claim:

1. A sliding Capo for use on a stringed musical instrument, said instrument including a neck having a width and a length, which comprises:

a track, including a pair of spaced surfaces, running substantially parallel to the length of said neck;

a substantially rigid cross piece spanning the width of said neck;

a pair of elongated flanges attached to said cross piece, said flanges slideably engaging said track;

a pair of bearings carried by said cross piece;

a shaft spanning the width of said neck and extending into said bearings; and a rotatable cylindrical elastomeric roller coaxial with said shaft.

2. A sliding Capo as recited in claim 1 and further including means for adjusting the distance between said flanges and said bearings.

3. A sliding Capo as recited in claim 2 wherein said means for adjusting the distance between said flanges and said bearings comprises:

a pair of bearing blocks carrying said bearings;

a pair of recesses in said cross member to receive said bearing blocks; and a pair of adjusting screws, each having its head bearing against one of said flanges, and each being threaded into one of said bearing blocks.

4. A sliding Capo for use on a stringed musical instrument, said instrument including a neck having a width and a length, which comprises:

a substantially rigid cross piece spanning the width of said neck;

a pair of elongated flanges attached to said cross piece;

a pair of bearings carried by said cross piece;

a shaft spanning the width of said neck and extending into said bearings;

a rotatable cylindrical elastomeric roller coaxial with said shaft; and a longitudinal track including two pairs of surface means, the first pair of said surface means being slideably engaged by said flanges for causing said rotatable roller to press against the strings of said instrument, and the second set of said surface means for limiting the rotation of said cross piece with respect to said strings.

5. A sliding Capo as recited in claim 4 and further including means for adjusting the distance between said flanges and said bearings.

6. A sliding Capo as recited in claim 5 wherein said means for adjusting the distance between said flanges and said bearings comprises:

a pair of bearing blocks carrying said bearings;

a pair of recesses in said cross member to receive said bearing blocks; and a pair of adjusting screws, each having its head bearing against one of said flanges and each being threaded into one of said bearing blocks.

7. In a stringed musical instrument of the lute family, the improvement which comprises:

a neck having a length and a width, and a track therein lengthwise of said neck;

a substantially rigid cross piece spanning the width of said neck;

a pair of flanges attached to said rigid cross piece and slideably engaging said track; and a cylindrical elastomeric roller rotatable about its axis carried by said rigid cross piece and pressing against the strings of said musical instrument.

8. In a stringed musical instrument as recited in claim 7 wherein the fingerboard of said musical instrument is curved, and further including:

a pair of bearings, one on each side of said neck and carried by said rigid cross piece, said bearings being formed of tapered holes; and a flexible shaft passing through the cylindrical axis of said cylindrical roller and extending into both of said bearings.

9. In a stringed musical instrument as recited in claim 8 wherein said bearings are holes in bearing blocks attached to said rigid cross piece, said bearing blocks being adjustable to adjust the pressure of said roller against said strings.

10. In a stringed musical instrument as recited in claim 9 wherein said bearing blocks are set in recesses in said cross piece, and further including threaded means acting between said flanges and said bearing blocks to adjust the pressure of said roller against said strings.

11. In a stringed musical instrument as recited in claim 7 wherein said bearings are holes in bearing blocks attached to said rigid cross piece, said bearing blocks being adjustable to adjust the pressure of said roller against said strings.

12. In a stringed musical instrument as recited in claim 11 wherein said bearing blocks are set in recesses in said cross piece, and further including threaded means acting between said flanges and said bearing blocks to adjust the pressure of said roller against said strings.

13. In a stringed musical instrument as recited in claim 7 wherein said track is comprised of a pair of channels in said neck, running lengthwise of said neck.

14. In a stringed musical instrument as recited in claim 13 wherein the fingerboard of said musical instrument is curved, and further including:

a pair of bearings, one on each side of said neck and carried by said rigid cross piece, said bearings being formed of tapered holes; and a flexible shaft passing through the cylindrical axis of said cylindrical roller and extending into both of said bearings.

15. In a stringed musical instrument as recited in claim 14 wherein said bearings are holes in bearing blocks attached to said rigid cross piece, said bearing blocks being adjustable to adjust the pressure of said roller against said strings.

* * * * *